US006123476A

United States Patent [19]

Rosenthal

[11] Patent Number: 6,123,476

[45] Date of Patent: Sep. 26, 2000

[54] CRAYON HOLDER WITH INTEGRAL SHARPENER

[76] Inventor: Donald M. Rosenthal, P.O. Box 696, Rancho Cucamonga, Calif. 91729

[ * ] Notice: This patent is subject to a terminal disclaimer.

[21] Appl. No.: 09/428,745

[22] Filed: Oct. 28, 1999

[51] Int. Cl.[7] ..... B43K 29/06

[52] U.S. Cl. ..... 401/51; 401/52; 401/83

[58] Field of Search ..... 401/52, 195, 55, 401/65, 66, 67, 82, 83, 87, 88, 29, 101, 117, 50, 51

[56] References Cited

U.S. PATENT DOCUMENTS

| | | | |
|---|---|---|---|
| 3,232,275 | 2/1966 | Ziegler et al. | 401/51 |
| 5,577,850 | 11/1996 | Mishima | 401/83 |
| 5,957,602 | 9/1999 | Rosenthal | 401/51 |

*Primary Examiner*—Henry J. Recla
*Assistant Examiner*—Tuan Nguyen

[57] ABSTRACT

A writing implement which employs a incremental advancement mechanism and a detachable sharpener. The sharpener, in turn, carries a detachable shavings container. This writing implement finds particular application in conjunction with crayons. The various components of the present invention, and the manner in which they interrelate, will be described more fully hereinafter.

4 Claims, 4 Drawing Sheets

CRAYON HOLDER WITH INTEGRAL SHARPENER

BACKGROUND OF THE INVENTION

1. Field of the Invention

The present invention relates to an improved writing implement, and more particularly pertains to implements for holding and incrementally advancing crayons.

2. Description of Related Art

Several other commonly owned wax pencil devices are known in the art. These include U.S. Pat. Nos. 5,551,787; 5,722,782; and 5,957,602 all of which are incorporated herein by reference. Each of these relate to wax pencil holding devices with a rotational advancement mechanism. None of these devices, however, contemplate the use of an incremental advancement mechanism. Furthermore, none of these devices employ the improved sharpening mechanism employed by the present invention.

Therefore, it can be appreciated that there exists a continuing need for a new and improved crayon holding device which includes a detachable sharpener and which employs an incremental advancement mechanism. In this regard, the present invention substantially fulfills this need.

BRIEF SUMMARY OF THE INVENTION

The general purpose of the present invention is to provide a crayon holding device with an incremental advancement mechanism, and which employs an improved sharpening mechanism.

To attain this, the present invention essentially comprises a combination crayon holder and sharpener. The holder includes an elongated body with a hollow interior as well as a first sharpening end and a second dispensing end. An elongated opening is formed within the length of the body with the opening having a series of recesses formed at a periphery. An advancing insert having a crayon engaging portion is included within the body. A resilient upstanding clutch is integral with the insert and includes opposing outwardly extending protrusions. The insert is positioned within the hollow interior of the elongated body such that the protrusions of the clutch engage the recesses of the tubular body. Thus, downward pressure on the clutch causes the protrusions to disengage from the recesses so as to permit forward movement of the clutch within the body. The sharpener has a first sharpening end and a second cylindrical insert and an enlarged cylindrical portion therebetween. The sharpening end has a frustro conical blade portion and an outer trapezoidal housing with an oblong aperture. The insert is positioned within the sharpening end of the housing by way of a friction fit.

It is therefore an object of the present invention to provide a crayon holding device with a detachable sharpener of an improved construction.

It is another object of the present invention to provide a crayon holder with a detachable sharpener, wherein the sharpener in turn supports a detachable shavings container.

It is a further object of the present invention to provide a combination crayon holder and sharpener with an incremental adjustment mechanism whereby measured lengths of the crayon can be sharpened.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DETAILED DESCRIPTION OF THE INVENTION

The present invention relates to a writing implement which employs an incremental advancement mechanism and a detachable sharpener. The sharpener, in turn, carries a detachable shavings container. This writing implement finds particular application in conjunction with crayons. The various components of the present invention, and the manner in which they interrelate, will be described more fully hereinafter.

Figure 1:
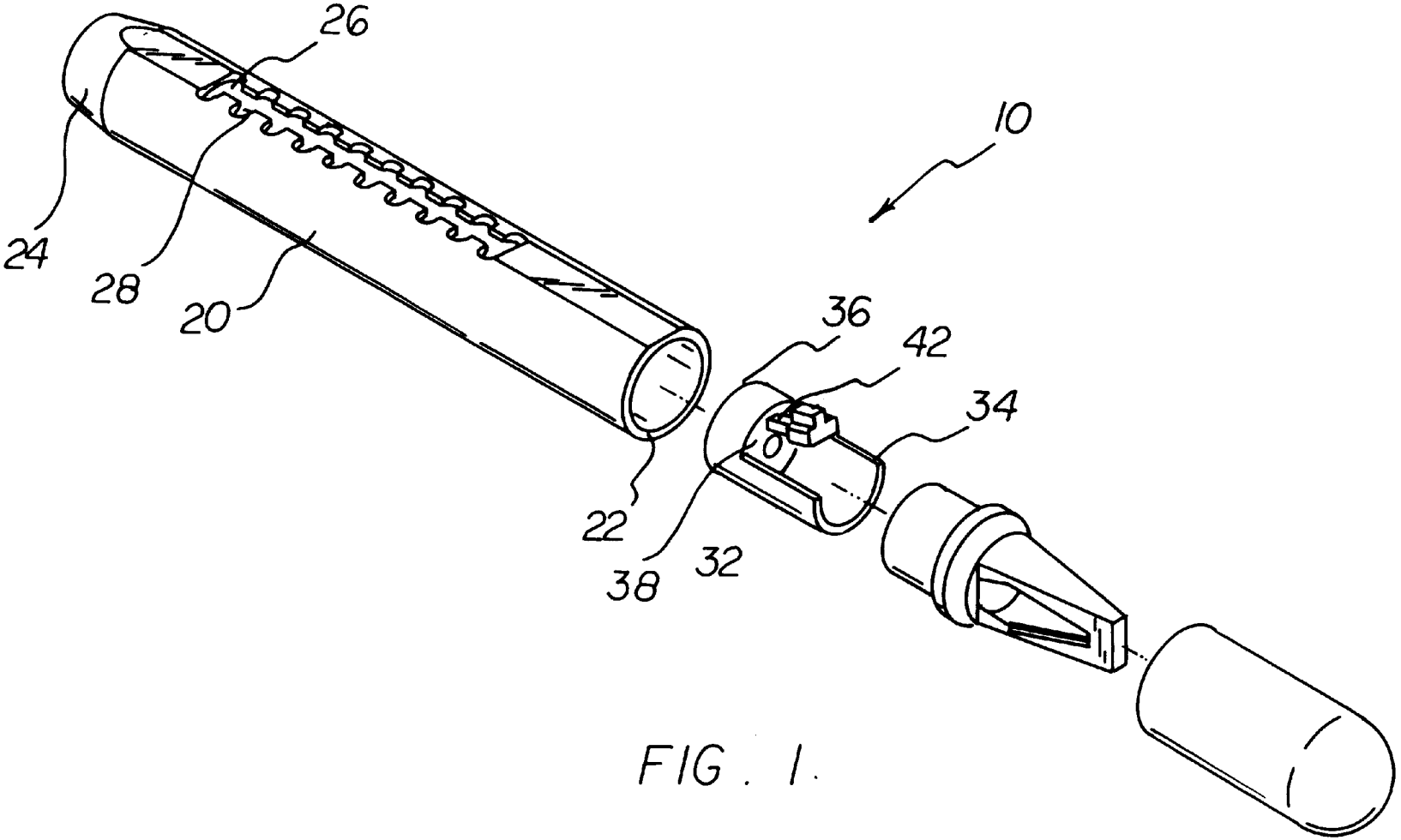
FIG. 1 is a perspective view of the crayon holder of the present invention.
Figure 2:
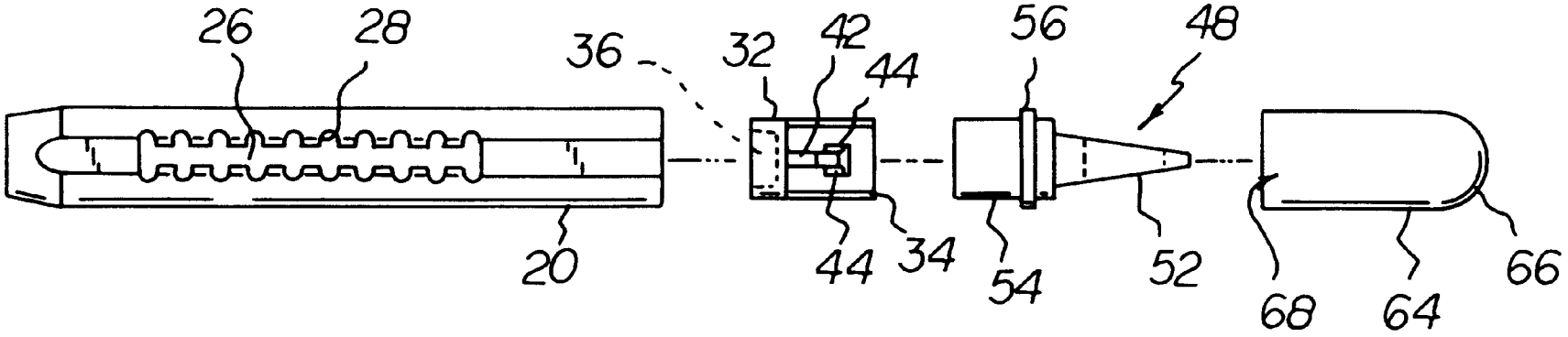
FIG. 2 is a plan view of the crayon holder of the present invention.
Figure 3:
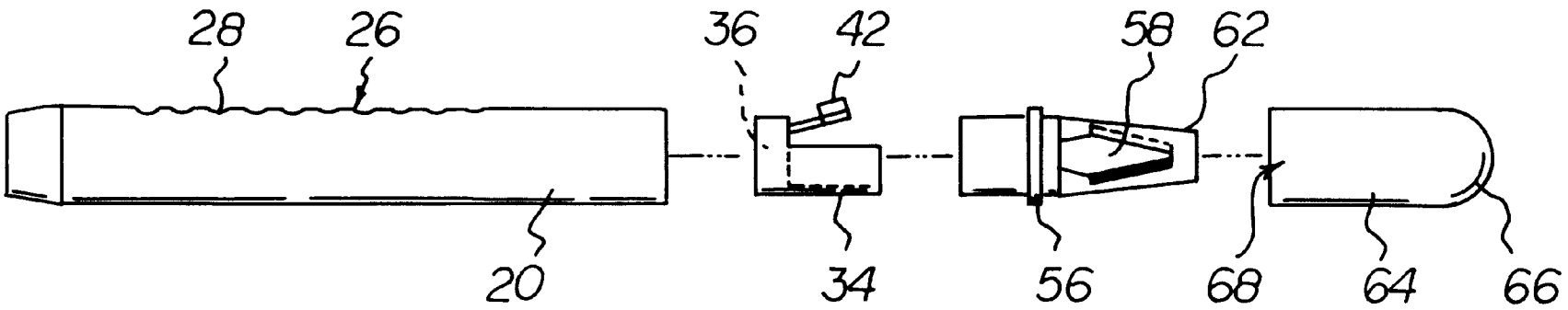
FIG. 3 is a side elevational view of the crayon holder of the present invention.

With reference to FIG. 1, the major structural feature of the holder 10 of the present invention is the elongated body 20. In the preferred embodiment, the body 20 is tubular in shape and includes a hollow interior. Furthermore, the body 20 is defined by a first sharpening end 22 and a second tapered dispensing end 24. Preferably, the dispensing end 24 has a hollow interior this is smaller than the hollow interior of the tubular body 20. The relationship between the dispensing end and the hollow interior is most clearly depicted in FIGS. 2 and 3. FIGS. 2 and 3 also depict the elongated opening 26 which is formed within the length of the tubular body 20. Such opening has a series of recesses 28 formed at a periphery. The function of these recesses 28 will be described in greater detail hereinafter.

The advancing insert 32 will be described next. This insert 32 is defined by a first semi-cylindrical portion 34 and a second cylindrical crayon engaging portion 36. Additionally, as is depicted in FIG. 1, an apertured divider 38 serves to separate the first and second portions of the insert 32. The insert also includes a resilient upstanding clutch 42. This clutch 42 includes opposing outwardly extending protrusions 44. The insert 32 is adapted to be positioned within the hollow interior of the elongated tubular body 20 such that the protrusions of the clutch 42 engage the recesses of the tubular body 20. Downward pressure on the clutch 42 causes the protrusions 44 to disengage from the recesses 28 so as to permit forward movement of the clutch 42 within the body 20. Thus, in the unbiased state, the protrusions 44 of the clutch 42 engage the recesses 28 in the body opening 26 preventing advancement of the insert 32. Forward movement can only be achieved by pressing on the insert 32 so as to disengage the protrusions 44 from the recesses 28. This system provides for the incremental advancement of the insert 32 and its associated crayon. The incremental advancement, coupled with the integral sharpener, allows for measured portion of the crayon to be sharpened.

Figure 4:
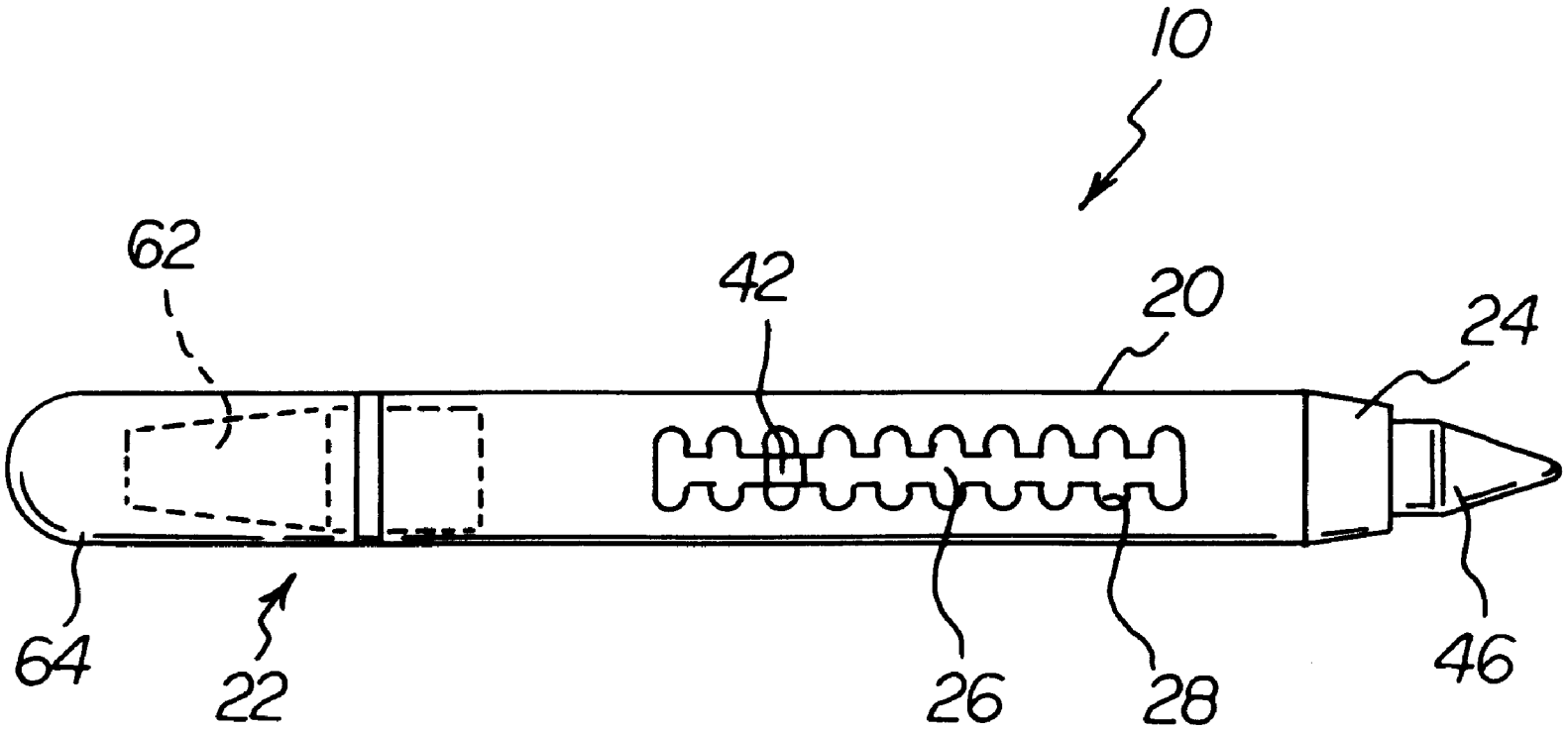
FIG. 4 is a plan view of the crayon holder.
Figure 5:
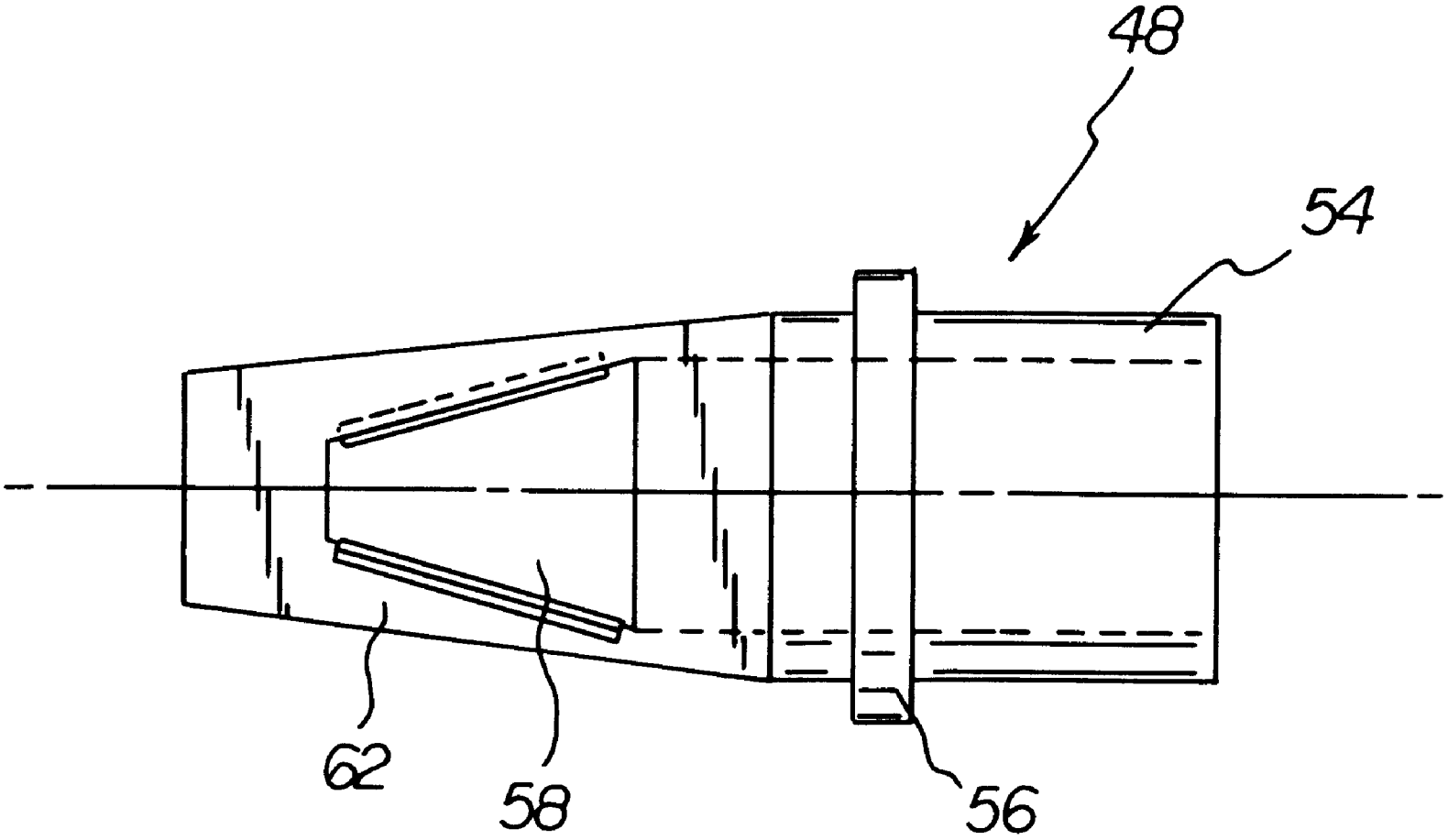
FIG. 5 is a detailed view of the sharpener.

FIG. 4 illustrates a crayon 46 which can be employed in conjunction with the holder 10 of the present invention. As is evident, this cylindrical crayon 46 is positioned within the crayon engaging portion 36 of the advancing insert 32. In the preferred embodiment this engagement is achieved by way of a friction fit. Thus, users can readily remove the crayon 46 to insert new crayons or crayons of different colors. Through its engagement with the insert 32, the crayon 46 is capable of linear movement within the housing.

The sharpener 48 of the holder will now be described. Such sharpener 48 is defined by both a first sharpening end 52 and a second cylindrical insert end 54. An enlarged cylindrical portion 56 serves to separate these two portions. The sharpening end 52 is preferably formed from a frustro conical blade portion 58. More specifically, the frustro conical portion 58 includes diametrically opposed blades. A operator thus sharpens the crayon tip be inserting it into the frustro conical portion 58 via the insert end 54 and then providing manual rotation. In this manner, the blades come into contact with the surface to the crayon and provide a sharpening effect. The sharpener also includes an outer trapezoidal housing 62 with an oblong aperture. It has been found that the addition of this additional housing helps to route the shavings into the adjacent shavings container. In the preferred embodiment, the entire insert end 54 is positioned within the sharpening end 22 of the housing by way of a friction fit. Thus, a user can easily remove the sharpener and bring it to the forward end of the holder.

Finally, the sharpener 48 also includes a shavings container 64. Preferably, such container 64 has a rounded first end 66 and a second opened end 68. The opened end 68 is fitted over the sharpening end 52 of the sharpener 48 by way of a friction fit. Thus, shavings created while sharpening a crayon are directed out through the trapezoidal housing 62 and into the shavings container 64. Thereafter, the shavings container 64 can be separately removed for disposal of the shavings.

This detailed description has been provided only for illustrative purposes. It is recognized that other embodiments may be articulated without departing from the objects and scope of the present invention. Any such modifications and variations are meant to be within the scope of the invention as contained within the following claims.

What is claimed as being new and desired to be protected by Letters Patent of the United States is as follows:

1. A combination crayon holder and sharpener comprising in combination:

an elongated tubular body with a hollow interior, a first sharpening end and a second tapered dispensing end with a hollow interior smaller than the hollow interior of the tubular body, an elongated opening formed within the length of the tubular body, the opening having a series of recesses formed at a periphery;

an advancing insert having a first semi-cylindrical portion and a second cylindrical crayon engaging portion, an apertured divider separating the first and second portions, a resilient upstanding clutch having opposing outwardly extending protrusions, the insert positioned within the hollow interior of the elongated tubular body such that the protrusions of the clutch engage the recesses of the tubular body, downward pressure on the clutch causing the protrusions to disengage from the recesses so as to permit forward movement of the clutch within the body;

a cylindrical crayon positioned within the crayon engaging portion of the advancing insert by way of a friction fit, the crayon being capable of linear movement within the housing by way of the advancing insert;

a sharpener having a first sharpening end and a second cylindrical insert and an enlarged cylindrical portion therebetween to keep the first sharpening end of the sharpener from entering the tubular body, the sharpening end of the sharpener having a frustro conical blade portion and an outer trapezoidal housing with an oblong aperture, the second cylindrical insert is positioned within the sharpening end of the housing by way of a friction fit;

a shavings container having a rounded first end and a second opened end, the opened end fitted over the sharpening end of the sharpener by way of a friction fit.

2. A combination crayon holder and sharpener comprising in combination:

an elongated body with a hollow interior, a first sharpening end and a second dispensing end, a elongated opening formed within the length of the body, the opening having a series of recesses formed at a periphery;

an advancing insert having a crayon engaging portion, a resilient upstanding clutch having opposing outwardly extending protrusions, the insert positioned within the hollow interior of the elongated body such that the protrusions of the clutch engage the recesses of the tubular body, downward pressure on the clutch causing the protrusions to disengage from the recesses so as to permit forward movement of the clutch within the body;

a sharpener having a first sharpening end and a second cylindrical insert and an enlarged cylindrical portion therebetween to keep the first sharpening end of the sharpener from entering the tubular body, the sharpening end of the sharpener having a frustro conical blade portion and an outer trapezoidal housing with an oblong aperture, the second cylindrical insert is positioned within the sharpening end of the housing by way of a friction fit.

3. The device as described in claim 2 further comprising a shavings container having a rounded first end and a second opened end, the opened end fitted over the sharpening end of the sharpener by way of a friction fit.

4. The devices as described in claim 2 further comprising a crayon positioned within the crayon engaging portion of the advancing insert by way of a friction fit, the crayon being capable of linear movement within the housing by way of the advancing insert.

* * * * *